United States Patent [19]

Tse

[11] 4,224,271

[45] Sep. 23, 1980

[54] PROCESS FOR BICONSTITUENT POLYMER COMPOSITIONS

[76] Inventor: Woon W. Tse, 204 Nga Tsin Wai Rd. 12F, Hong Kong, Hong Kong

[21] Appl. No.: 635,137

[22] Filed: Nov. 25, 1975

Related U.S. Application Data

[62] Division of Ser. No. 387,238, Aug. 10, 1973, abandoned.

[51] Int. Cl.[2] ..... D01F 6/00

[52] U.S. Cl. ..... 264/184; 264/210.8

[58] Field of Search ..... 264/184, 210.8; 260/557 H

[56] References Cited

U.S. PATENT DOCUMENTS

| | | | |
|---|---|---|---|
| 3,642,706 | 2/1972 | Morgan | 264/184 |
| 3,884,989 | 5/1975 | Blomberg | 264/184 |
| 3,888,965 | 6/1975 | Kwolek | 264/184 |

*Primary Examiner*—Jay H. Woo

*Attorney, Agent, or Firm*—Horace S. Harper

[57] ABSTRACT

This invention relates to a method of producing a high polymer composition for use in the manufacture of textiles which consist of an admixture of polyacrylonitrile and an aromatic polyamide.

7 Claims, No Drawings

PROCESS FOR BICONSTITUENT POLYMER COMPOSITIONS

This is a division of application Ser. No. 387,238, filed Aug. 10th, 1973 now abandoned.

This invention relates to novel synthetic high polymer compositions for use in the manufacture of textile filaments, fibres, yarns and/or fabrics and to the textile filaments, fibres, yarns and/or fabrics per se. Accordingly the present invention provides a synthetic high polymer composition for use in the manufacture of textile filaments, fibres, yarns and/or fabrics which comprises a polyacrylonitrile containing recurring structural units of formula, $$-CH_2-\underset{\underset{CN}{|}}{CH}-CH_2-\underset{\underset{CN}{|}}{CH}- \qquad (I)$$

in admixture with, and/or copolymerised with, an aromatic polyamide containing recurring structural units of formula, $$-\overset{\overset{H}{|}}{N}-AR_1-\overset{\overset{H}{|}}{N}-\overset{\overset{O}{\|}}{C}-Ar_2-\overset{\overset{O}{\|}}{C}- \qquad (II)$$

wherein $Ar_1$ and $Ar_2$ are the same or different and are substituted or unsubstituted divalent aromatic radicals and it is preferable that none of the $Ar_1$ radicals or $Ar_2$ radicals are replaced by nonaromatic radicals.

Hereinafter the polyacrylonitrile is referred to as the A - constituent and the aromatic polyamide as the B - constituent of the polymer composition.

The recurring structural units of the A - constituent may be attached to other functional chemical groups such as vinyl acetate, methyl acrylate, amine, imine, pydridine, sulphonic, phosphoric or carboxylic groups.

It is known that the A - constituent by itself can be wet spun or dry spun and filaments or fibres spun from solely A - constituent generally have a tenacity of not more than 4 grammes per denier and an initial modulus of 40 grammes per denier, and have only a moderate degree of thermal resistance. Filaments or fibres spun from a solely B - constituent also have a tenacity of about 4 grammes per denier but a very high degree of thermal resistance.

The object of the present invention is to provide a synthetic high polymer composition comprising a mixture of the A - constituent and the B - constituent and depending on the conditions of the manufacture and the proportions of the two constituents in the filaments, fibres yarns and/or fabrics, a range of materials may be produced having a range of properties, in many cases much superior properties to those of the materials comprising the A - constituent or B - constituent alone.

Thus, in an embodiment a mixture of the A - constituent and the B - constituent can be dissolved together in suitable solvents such as dimethyl-formamide which may also contain a solubility promoter such as lithium chloride to form a spinning dope. The concentration of the dope is preferably between 15% to 20% w/w/ when dimethyl formamide is used as solvent. The dope is then deareated and forced through a spinneret into a bath containing a coagulant such as dimethyl formamide in water, where the solvent is extracted from the filament. The coagulated filaments are then given a washing, drawing and heat setting process. For reasons of economy these manufacturing stages can be combined as is well known into one continuous process on the same thread line.

During filament extrusion, jet stretch values of 0.3 to 0.5 were found to give the best results. When aqueous solutions of dimethylformamide is used as coagulant, the concentrations of the coagulation bath are not critical and the optimum conditions are between 60 to 70 parts of dimethyl formamide in 40 to 30 parts of water.

Drawing of the filaments after coagulation is the most important stage, for the tensile strength of filaments formed from polymer compositions of the present invention is directly proportional to the amount of drawing that has been given to them. Drawing of the filament can be carried out before or after the washing stage. It is found, however, that drawing of the coagulated filaments before washing is to be preferred. While different drawing methods can be used, it is preferable, in order to develop maximum strength, that the filaments be drawn in contact with water either as steam or hot liquid water. The drawn filaments should then be washed to remove the residual coagulant and solvent. Depending on the proportion of the A - constituent and B - constituent in the filament, such filaments so manufactured are very strong and have very good physical properties as well as chemical resistance and thermal stability. By exposing these filaments to heat for a length of time, for example, 1 second, at a temperature of, for example, 165° C., there is generally an increase in tenacity and break elongation. The tension of the filaments during heat setting is critical. At zero tension during heat setting the filament increases both in tenacity and break elongation. If 5% to 10% shrinkage is allowed during heat setting there is only a slight increase in tenacity, but a much greater increase in break elongation. Although any heat setting temperature up to 220° C. or higher can be used, 165° C. is found to be the most preferable. The heat may be supplied to the filament or fibre by contact with a hot metal or a ceramic plate or cylinder, by a hot gaseous atmosphere, by a fluidised bed of metal or sand or by a heat radiating element. While drawing induces orientation of the molecules, heat setting gives this A-B-biconstituent filament a higher crystallinity, as shown by X-ray diffraction pattern analysis.

The filaments, fibres, yarns and fabrics produced from the polymer compositions of this invention possess excellent strength, elasticity and modulus and have very good resistance to moderately high temperature for a prolonged period of time. Since the A-constituent and the B-constituent can be mixed in any proportions during manufacture to give materials of the desired qualities, this invention offers commercial as well as industrial utility in a wide range of end uses. The filaments, fibres, yarns and fabrics of this invention can be shaped for general textile consumer end uses. The stronger types of materials of this invention can be used in tire cords, conveyor belts, safety belts, parachutes, fish lines, nets, sail cloth, ducts, hoses, insulation cordages and cables. The good heat resistance of these materials enables them to be used in protective coating for boilers, hot pipes, in filtering units of hot liquids and gases, in hot water pipe and hot air ventilation.

This invention will be explained in detail by the following examples in which all parts and percentages are by weight unless otherwise stated.

EXAMPLE 1

98 parts of A-constituent (polyacrylonitrile polymer) and 2 parts of B-constituent (poly-m-phenylene isophthalamide) are cut into fine particles and are mixed together and dissolved to a concentration of 15% in a mixture of 95 parts dimethyl - formamide, 5 parts lithium chloride. This solution is maintained at 60° C. for 24 hours with agitation to give a homogeneous mixture of the constituents and to facilitate their dissolution. In some cases it is found necessary to prolong the dissolving time. This solution is spun through a 5-hole spinneret, in which the orifice has a diameter of 75 microns, into a coagulation bath of 60 parts dimethylformamide and 40 parts water maintained at 5° C. The coagulated filaments are led through a rinsing bath of water of 60° C. and thereafter drawn to approximately 10 times its original length by passing them at the rate of 12 meters per minute, through a tube of steam. The final fibre has a tenacity of 7.6 grammes per denier, with a 12% elongation at break and an initial modulus of 84 grammes per denier.

Another example of the same 98 parts A-constituent/2 parts B-constituent copolymer is dissolved in a mixture of 95 parts dimethyl-formamide and 5 parts lithium chloride to give a 15% solution. This solution is spun as described in the above example. The coagulated and rinsed fibre is drawn 9 times its original length by passing it in contact with a hot metal plate 20 cm in length maintained at 155° C. The final fibre has a tenacity of 6.7 grammes per denier, 13% break elongation and an initial modulus of 86 grammes per denier.

EXAMPLE 2

94 parts of A-constituent and 6 parts of B-constituent are mixed and dissolved to a concentration of 15% in 95 parts dimethyl-formamide and 5 parts lithium chloride. The solution dope is spun as described in Example 1. The coagulated and rinsed fibre is drawn 13 times its original length by passing it through a tube of steam at a speed of 14.3 meters per minute. The resultant fibre has a tenacity of 7 grammes per denier, 15.6% break elongation and an initial modulus of 100 grammes per denier. The same steam drawn fibre is then a heat setting treatment by passing it in contact with a heated metal plate at 165° C. for 1 second. The fibre is drawn 6% times its original length during the heat setting treatment. The final fibre has a tenacity of 8.0 grammes per denier, 15.5% break elongation and an initial modulus of 113 grammes per denier.

EXAMPLE 3

90 parts of A-constituent and 10 parts of B-constituent are mixed and dissolved to a concentration of 15% in 95 parts dimethyl-formamide and 5% lithium chloride. The spinning dope so prepared is spun as described in Example 1. The coagulated fibre is drawn 16 times its original length in a tube of steam. The drawn fibre, after rinsing and drying, has a tenacity of 8.0 grammes per denier, 15.6% break elongation, and an initial modulus of 88 grammes per denier. The same steam drawn fibre is then given a heat setting treatment by passing it in contact with a heated plate at 155° for 1 second. The fibre is allowed to shrink 10% during the heat setting stage. The final fibre has a tenacity of 9.0 grammes per denier, 22% break elongation and an initial modulus of 122 grammes per denier.

In another example, the same fibre, after steam drawing to 16 times its original length and rinsed, is given a heat setting treatment by passing it in contact with a heated metal plate at 155° C. for 1 second. The original length of the fibre is maintained during heat setting. The final fibre has a tenacity of 10 grammes per denier, 21% break elongation and an initial modulus of 140 grammes per denier.

EXAMPLE 4

88 parts of A-constituent and 12 parts of B-constituent are mixed and cut into fine particles and dissolved to a concentration of 19% in 95 parts dimethyl formamide and 5 parts lithium chloride. The dope so formed is spun through a spinneret of 5 holes each having an orifice of 75 microns into a coagulation bath of 65 parts dimethylformamide and 35 parts water at 5° C. The coagulated fibre is drawn 14 times its original length in steam and then washed and dried. The final fibre has a tenacity of 7 grammes per denier, 14% break elongation and an initial modulus of 110 grammes per denier. The same fibre after heat setting at 155° C. for 1 second at zero tension has tenacity of 7 grammes per denier, 17% break elongation and an initial modulus of 169 grammes per denier.

EXAMPLE 5

80 parts of A-constituent and 20 parts of B-constituent are mixed and dissolved to 15% concentration in 95 parts dimethyl-formamide and 5 parts lithium chloride. The solution is spun as described in Example 1. The fibre is drawn 10 times its original length in steam. The final fibre has a tenacity of 5 grammes per denier, 12% break elongation and an initial modules of 65grammes per denier.

EXAMPLE 6

50 Parts of A - constituent and 50 parts of B-constituent are mixed and cut into fine particles, dissolved to 15% concentration in 95 parts of dimethyl formamide and 5 parts of lithium chloride. The solution is spun as described in Example 1. This fibre is drawn in steam 4 times its original length. The final fibre has a tenacity of 1.4 grammes per denier, 16% break elongation and an initial modulus of 47 grammes per denier.

What I claim is:

1. A method for producing polymer textile filaments comprising the steps of cutting into fine particles as a major constituent a polyacrylonitrile polymer containing recurring structural units of formula,

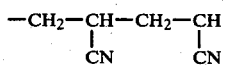

and as the minor constituent an aromatic polyamide containing recurring structural units of formula,

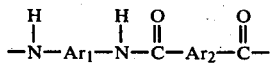

wherein $Ar_1$ and $Ar_2$ are the same or different substituted or unsubstituted divalent aromatic radicals, adding a solvent of dimethyl formamide containing a solubility promoter to the particles to provide a spinning dope, deaerating the dope and then forcing the dope through a spinneret and into a coajulant containing bath in order to extract the solvent, thereafter drawing the resulting filament through a steam bath and finally exposing the filament to heat of at least 165° C. for about one second to increase the tenacity and break elongation of the filament.

2. A method as claimed in claim 1 wherein the solvent is methyl formamide and the soluble solubility promoter is lithium chloride.

3. A method as claimed in claim 1 wherein the dope composition contains not less than 15% by weight of the dissolved polymer.

4. A method as claimed in claim 1 wherein the polyamide is poly-m-phenylene diamine isophthalamide.

5. A method as claimed in claim 1 wherein the filament is drawn to at least two times its original length when subjected to heat.

6. A method as claimed in claim 1 wherein the filament is subjected to a temperature of about 220° C. for at least 1/10 second but not more than one second.

7. A method as claimed in claim 1 wherein the coagulant bath contains dimethyl formamide in water in order to extract the solvent.

* * * * *